US011229291B1

(12) United States Patent
Collier

(10) Patent No.: US 11,229,291 B1
(45) Date of Patent: Jan. 25, 2022

(54) ERGONOMIC MOTION CHAIR

(71) Applicant: Michael David Collier, Lake Oswego, OR (US)

(72) Inventor: Michael David Collier, Lake Oswego, OR (US)

( * ) Notice: Subject to any disclaimer, the term of this patent is extended or adjusted under 35 U.S.C. 154(b) by 0 days.

(21) Appl. No.: 17/307,942

(22) Filed: May 4, 2021

(51) Int. Cl.
*A47C 1/032* (2006.01)
*A47C 7/02* (2006.01)

(52) U.S. Cl.
CPC ..... *A47C 1/03255* (2013.01); *A47C 1/03266* (2013.01); *A47C 7/029* (2018.08)

(58) Field of Classification Search
CPC . A47C 1/032; A47C 1/03255; A47C 1/03266; A47C 7/029
USPC ..... 297/314
See application file for complete search history.

(56) References Cited

U.S. PATENT DOCUMENTS 3,567,280 A 3/1971 Bradshaw
3,711,152 A 1/1973 Sirpak et al.
4,575,151 A * 3/1986 Edstrom ..... A47C 7/445 297/303.3
5,261,723 A 11/1993 Hosoe
(Continued)

FOREIGN PATENT DOCUMENTS

CA 2816224 C 5/2012
DE 202009004382 8/2009
(Continued)

OTHER PUBLICATIONS

Internet Web Page: https://www.youtube.com/watch?v=7suPTql6EqA&ab_channel=QOR360 Posted: Apr. 25, 2019.
(Continued)

*Primary Examiner* — Rodney B White

(57) ABSTRACT

A chair that provides movement side-to-side about a first pivot axis positioned above the seat plane allows the user a wide range of dynamic movement, but does not require constant or excessive action on the part of the user to maintain a desired position. In addition and concurrently thereto, the structure may include a second pivot that is also positioned above the seat plane and that provides forward-and-back movement of the seat. The first and second pivot axes can be engaged synchronously or independently by the user as desired delivering infinite degrees of angles of movement. Said pivot axes are more closely adjacent to the human body pivot joints and axes. The seat and seat back may be joined together to a central spine frame that moves about the second pivot, thereby maintaining the seatback position and seat position relative to each other during forward-and-back movement of the spine along the second pivot. One or more biasing structures may be provided to urge the seat into forward-and-back and side-to-side neutral positions. If desired, the location of this forward-and-back neutral position can be statically adjusted by a user, and at least one of the biasing structures can hold this forward-and-back neutral position at a desired tension level thereby allowing a user to select the amount of force required to move the seat out of this defined forward-and-back neutral position. Moreover, an adjustment structure may be provided that allows for static adjustment of the seatback's position on the spine.

21 Claims, 20 Drawing Sheets

(56) References Cited

U.S. PATENT DOCUMENTS

| | | | | |
|---|---|---|---|---|
| 5,522,106 | A | 6/1996 | Harrison et al. | |
| 6,283,551 | B1 | 9/2001 | Bergin | |
| 6,609,755 | B2 | 8/2003 | Koepke et al. | |
| 6,866,340 | B1 | 3/2005 | Robertshaw | |
| 7,100,983 | B1 * | 9/2006 | Gant | A47C 3/025 297/314 |
| 7,234,768 | B2 | 6/2007 | Manning | |
| 7,789,463 | B2 * | 9/2010 | Gang | A47C 3/0252 297/314 |
| 8,029,060 | B2 * | 10/2011 | Parker | A47C 7/445 297/314 X |
| 8,087,724 | B2 | 1/2012 | Kosik et al. | |
| 8,534,758 | B2 | 9/2013 | Rivera | |
| 8,662,586 | B2 | 3/2014 | Serber | |
| 8,919,881 | B2 | 12/2014 | Bay | |
| 8,926,017 | B2 | 1/2015 | Grove et al. | |
| 8,944,507 | B2 | 2/2015 | Goetz | |
| 9,211,013 | B2 | 12/2015 | Harrison et al. | |
| 9,498,066 | B2 | 11/2016 | Christianson et al. | |
| 9,717,340 | B2 | 8/2017 | Rivera | |
| D815,218 | S | 4/2018 | Osler | |
| 10,010,758 | B2 | 6/2018 | Osler et al. | |
| 10,226,127 | B2 | 3/2019 | Harrison et al. | |
| 10,314,400 | B2 | 6/2019 | Colonello et al. | |
| 10,383,445 | B2 | 8/2019 | Serber | |
| 10,820,704 | B2 * | 11/2020 | Sugano | A47C 3/026 |
| 10,842,276 | B2 * | 11/2020 | Sugano | A47C 7/14 |
| 2003/0164638 | A1 | 9/2003 | Funk et al. | |
| 2008/0290712 | A1 * | 11/2008 | Parker | A47C 1/023 297/354.11 |
| 2016/0081478 | A1 * | 3/2016 | Ehrenleitner | A47C 3/18 297/314 |
| 2016/0081483 | A1 | 3/2016 | Harrison et al. | |
| 2016/0367027 | A1 | 12/2016 | Voigt et al. | |
| 2018/0272191 | A1 | 9/2018 | Osler et al. | |
| 2019/0045928 | A1 * | 2/2019 | Yajima | A47C 7/006 |
| 2019/0254430 | A1 | 8/2019 | Colonello et al. | |
| 2019/0281985 | A1 * | 9/2019 | Kinoshita | A47C 1/03 |
| 2019/0281986 | A1 * | 9/2019 | Sugano | A47C 3/0257 |
| 2019/0290006 | A1 * | 9/2019 | Kinoshita | A47C 3/026 |
| 2019/0298070 | A1 | 10/2019 | Lawson | |
| 2019/0343286 | A1 * | 11/2019 | Sugano | A47C 3/026 |
| 2020/0085195 | A1 * | 3/2020 | Shibamoto | A47C 3/0255 |

FOREIGN PATENT DOCUMENTS

| | | | |
|---|---|---|---|
| EP | 1163865 | A2 | 12/2001 |
| EP | 1698254 | A1 | 9/2006 |
| EP | 1911374 | B1 | 8/2010 |
| KR | 101492896 | B1 | 2/2015 |
| RU | 2437605 | C2 | 6/2008 |
| WO | WO1996014041 | A1 | 5/1996 |
| WO | WO2020010468 | A1 | 1/2020 |

OTHER PUBLICATIONS

Internet Web Page: https://www.youtube.com/watch?v=cymh6eUViF4&ab_channel=VermontPBS Posted: Nov. 17, 2016.

* cited by examiner

ERGONOMIC MOTION CHAIR

FIELD OF THE INVENTION

This invention relates to an ergonomic motion chair with an assembly that allows a user to easily optimize and adjust their sitting position. In particular, the chair includes structures that allow the seat to be easily positioned and adjusted side-to-side from a neutral position along a defined pivot axis above a seat plane, and it may, if desired, also provide forward-and-back movement of the seat about a second pivot located above the seat plane.

BACKGROUND

Stationary sitting for long periods of time can be dangerous to one's health. Studies have shown that it can shorten one's lifespan due to health risks such as heart disease, obesity, diabetes, depression, and an array of orthopedic injuries and muscle degeneration. Moreover, bio-mechanical injuries and muscular-skeletal challenges can result from the restriction of movement, prolonged joint compression and poor blood circulation of long-term sitting.

The human body can move at a multitude of joints in wide degrees of angles in all axes. Allowing the body to move along its range of motion while seated can reduce or mitigate the harmful effects of long-term sitting.

To date, designers have made many attempts to provide ergonomic improvements to chairs aimed at allowing increased user movement while sitting. For example, chair designers have attempted to tilt and toggle the seat of a chair by either having the user sit on a large movable ball or have them perched on a seat connected to a base by a ball joint or resilient structure. Examples of these latter designs can be found in U.S. Pat. No. 6,866,340 to Robertshaw, U.S. Pat. No. 8,919,881 to Bay, and U.S. Pat. No. 9,211,013 to Harrison at al. These types of chairs allow the seat to tilt and toggle in all directions usually about a toggle point, thereby requiring the user to take affirmative action such as using one's legs and stomach muscles to balance and hold the seat in a desired position while seated. This action provides a form of exercise while seated, but it usually comes at the expense of providing no or limited back support. Moreover, teetering on a ball, ball joint, universal hinge, or the like while seated can become tedious, uncomfortable and increase fatigue for a user during long-term sitting.

Some designers have attempted to improve the ergonomics of a chair by allowing the seat to slide within the frame relative to a seatback. An example of these types of designs can be found in U.S. Pat. No. 8,662,586 to Serber. These designs include structures that allow the seat to move, usually forward and backward, independently of a separate seatback to allow a user to tilt forward or recline in the chair. These types of chairs usually include an adjustment structure that allows the seatback to be preset to an optimal position when the user is seated normally in the chair, however, the sliding movement of the seat relative to the preset position of the seatback typically changes the user's position relative to the seatback, thereby compromising the comfort, chair fit and health benefits of the chair while the user is tilted forward or reclined in the chair.

More recently, inventors have attempted to improve seat comfort while still allowing for some body movement by requiring the user to sit in a bucket that rotates front-to back about a fixed pivot point in a seat frame. Examples of this type of design can be found in U.S. Pat. No. 3,711,152 to Sirpak et al. and U.S. Pat. No. 10,314,400 to Colonello et al.

The pivoting movement of the bucket front-to-back requires the user to use their legs and arms to hold a seated position, thereby reducing slouching and the like. Like sitting on a ball, these types of designs require affirmative action on the part of the user to hold a desired position, thereby providing a form of exercise for the user. However, these types of designs limit movement to allowing only forward-and-back tilting while cradling the user in the bucket in all other directions. This restriction of allowable movement of the bucket adversely limits the range of movement of the user while seated, thereby compromising and limiting chair fit, user comfort, and the health benefits of the chair.

In addition, inventors have provided structures that allow a seat to "teeter" or "wobble" side-to-side or front to back while a user is seated. An example of this type of structure can be found in U.S. Pat. No. 10,010,758 to Osler et al. It rests the seat on a "half-pipe" or "hemispheric- or dome-shaped rocking mechanism" upon which the user is required to balance the seat. Maintaining balance on the seat requires affirmative action on the part of the user, thereby providing some exercise for the user. However, the total range of movement of the user's body that this structure provides is limited. Moreover, as with sitting on a ball or teetering structure, maintaining a seated position on this seat can increase fatigue and become unsteady, tedious and uncomfortable for the user over time.

SUMMARY

Thus, despite the known structures for improving the ergonomics of a chair and its fit, there remains a need for an ergonomic motion chair that provides a wide range of dynamic movement, about more axes, more relative to the human body anatomy, for the user while seated in it, but does not require constant or excessive action on the part of the user to maintain a desired position. The present invention fulfills this and other needs as set forth herein.

In one disclosed embodiment, the chair has a structure that allows the seat to be easily positioned and adjusted side-to-side from a neutral position along a defined pivot axis that is positioned above a seat plane. This side-to-side swinging movement of the seat below the defined pivot axis allows a user to dynamically select, adjust and hold a desired side-to-side seat position. Moreover, gravity can urge the seat to balance to a central side-to-side neutral position and a biasing structure may also be provided to further urge the seat to return to this side-to-side neutral position. In addition, by the weight of the user combined with this geometry helps naturally urge the seat to return to the neutral position and requires the user to exert significantly less effort to return to a side-to-side neutral position unlike any other chair constructions.

In addition and concurrently thereto, the structure may include a second pivot that is also positioned above the seat plane and that provides forward-and-back movement of the seat. The seat and seat back may be joined together to a central spine that moves about the second pivot, thereby maintaining the seat back position and seat position relative to each other during forward-and-back movement of the spine along the second pivot. A second biasing structure operably secured to the spine can hold and maintain the forward-and-back position of the seat in a desired forward-and-back neutral position.

If desired, the location of this forward-and-back neutral position may be statically adjusted as desired by a user, and the second biasing structure can hold this forward-and-back neutral position at a desired tension level thereby allowing a user to select the amount of force required to move the seat out of this defined forward-and-back neutral position. Moreover, an adjustment structure may be provided that allows for static adjustment of the seatback's position on the spine, which once selected by a user will hold that position relative to the seat as the spine moves about the second pivot.

By allowing the seat plane to rotate, swing and adjust side-to-side with the forward-and-back simultaneously, and synchronic together, about the first and second pivot axes, a user's body can move to many more, infinite positions during the seating period than by any other chair construction. The chair mechanism of the current invention will unlock the hip swing, relative to a human body, about an axis whereby said first axis is critically located above the seat plane structure, and located in approximate and adjacent area of the center of the pelvis, whereby the user can rotate, or swing the pelvis side-to-side with full control and not having the sensation of "tipping off" and/or "teetering" and/or "balancing" the seat plane as found in all other designs where the axis of rotation is located below the user's body.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

FIG. 8 is a front, plan view, cut away, of the ergonomic motion chair of FIG. 1 with the ergonomic motion chair in the forward-and-back neutral position of FIG. 2 and the left swing position of FIG. 3.

DETAILED DESCRIPTION

An ergonomic motion chair 100 that provides a wide range of dynamic movement for the user while seated in it, but does not require constant or excessive action on the part of the user to maintain a desired position is shown in FIGS. 1-20.

Figure 2:
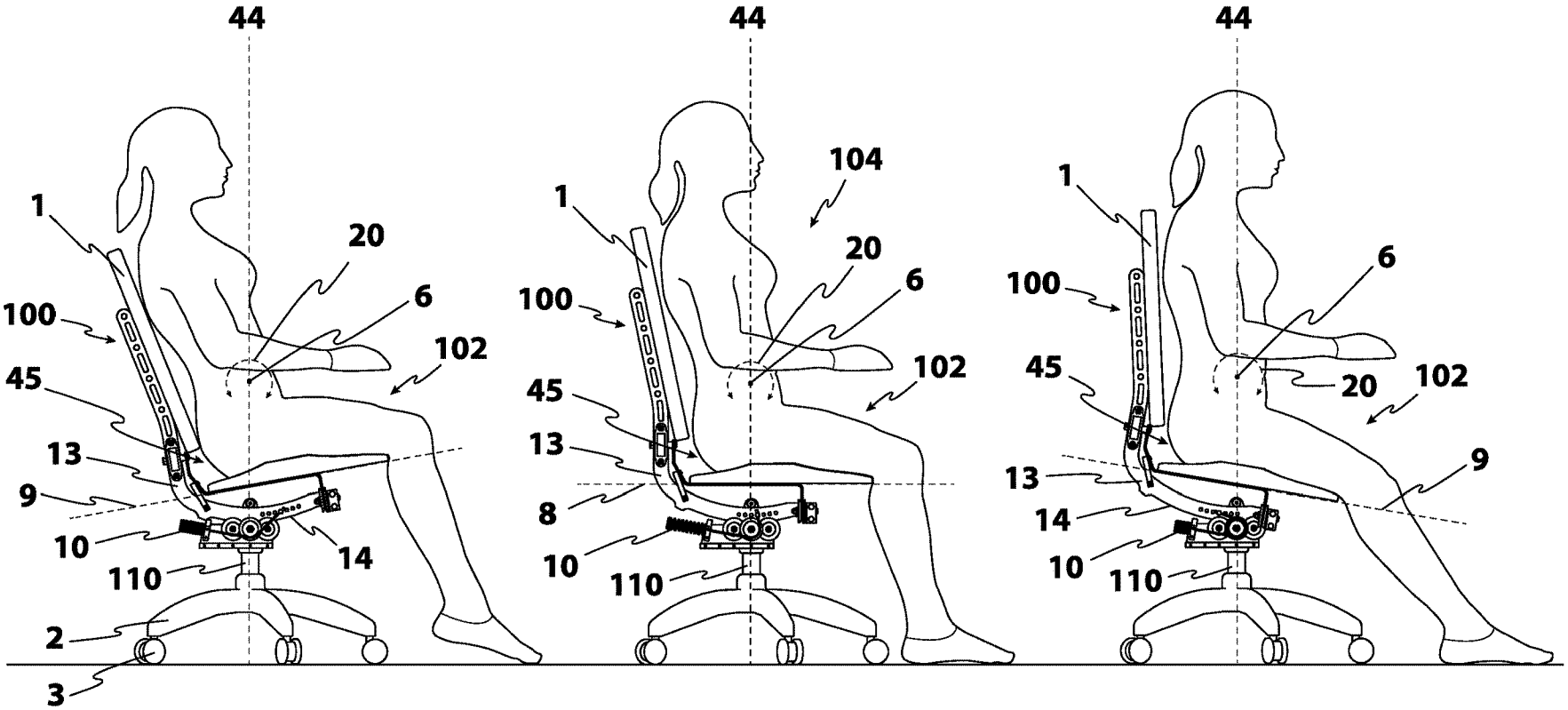
FIG. 2 is a left side plan view of the ergonomic motion chair of FIG. 1 showing possible forward-and-back movement defining a back position, a forward-and-back neutral position, and a forward position of the chair with a person shown sitting in the chair for orientation.
Figure 3:
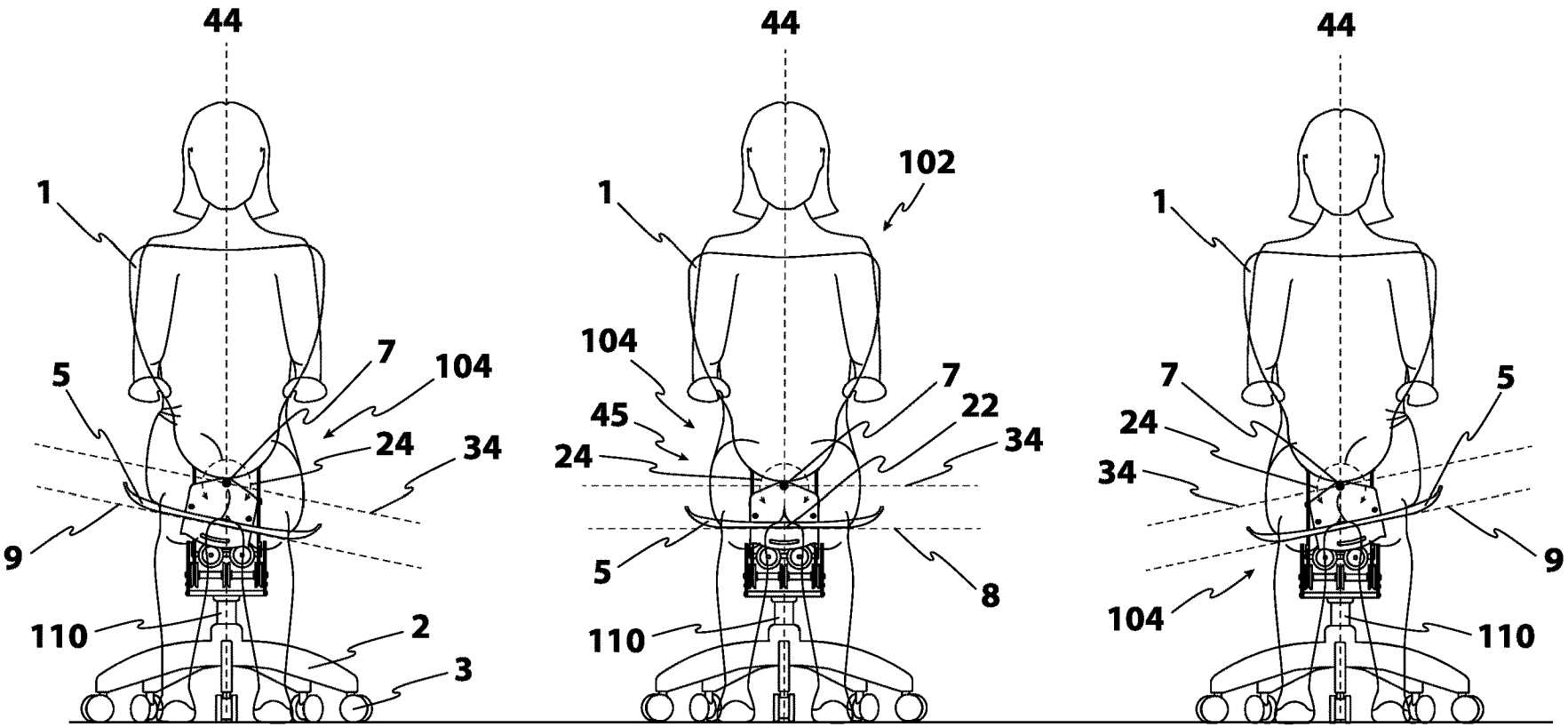
FIG. 3 is a front plan view, cut away of the ergonomic motion chair of FIG. 2 showing possible side-to-side movement defining a right swing position, a side-to-side neutral position, and left swing position of the chair with the chair in the forward-and-back neutral position of FIG. 2 and with a person shown sitting in the ergonomic motion chair for orientation.
Figure 4:
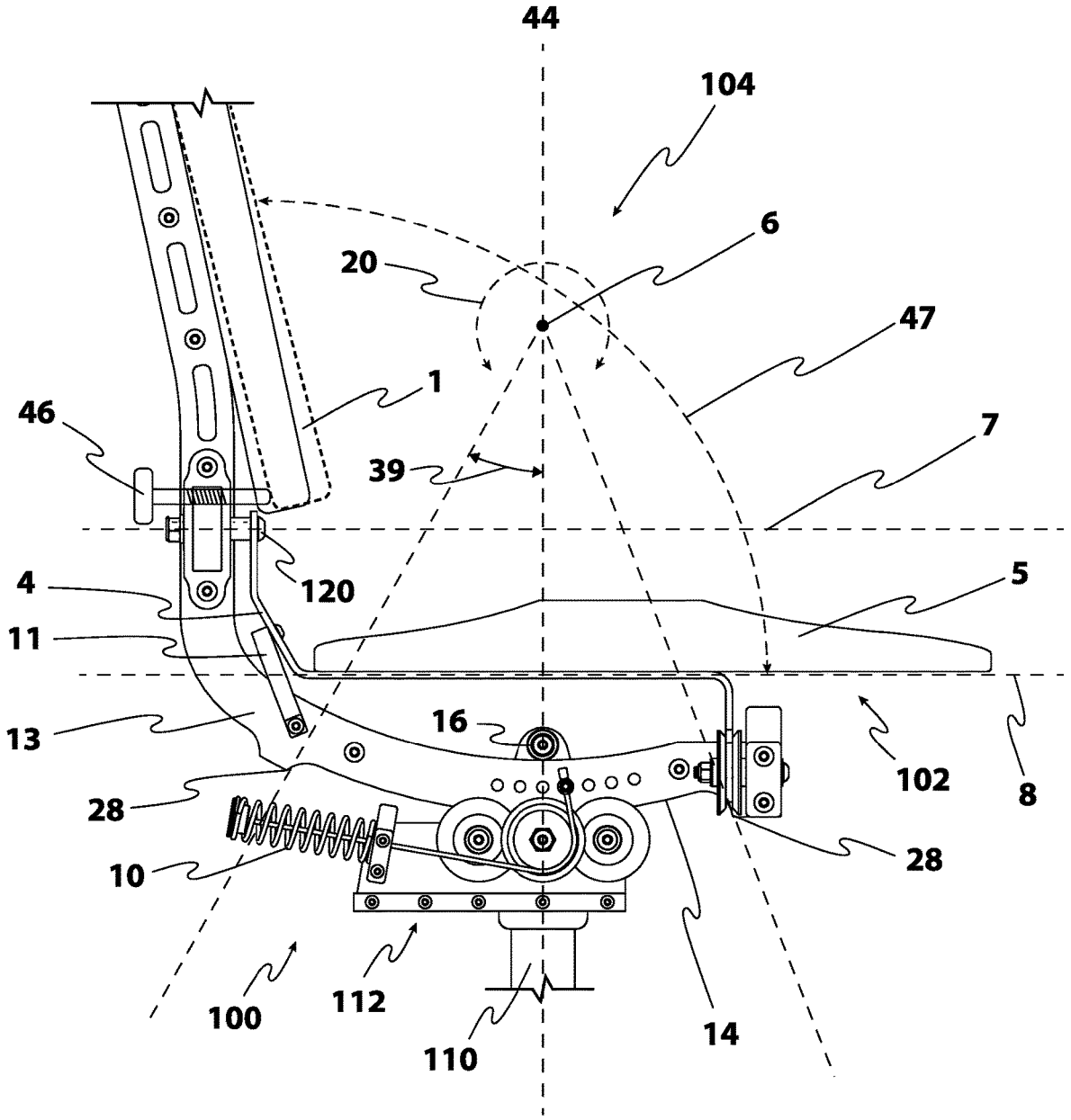
FIG. 4 is an enlarged partial, left side view, cut away of the ergonomic motion chair of FIG. 1 showing a possible forward-and-back pivot axis positioned above a seat plane.

As best shown in FIG. 3, the ergonomic motion chair 100 may include a seat 5 defining a seating surface, the seat operably secured to a frame with a structure that allows the seat plane 8 to be easily and dynamically positioned and adjusted side-to-side 9 from a side-to-side neutral position 102 along a defined pivot axis 7 that is positioned above the seat plane 8. Preferably and as best shown in FIGS. 2 & 4, the ergonomic motion chair 100 may also include a second pivot 6 that is also positioned above the seat plane 8 that allows the seat plane 8 to be easily and dynamically positioned and adjusted about f forward-and-back from a forward-and-back neutral position 104 to provide forward-and-back movement of the seat. A side-to-side biasing structure 11 (FIGS. 4, 9, 14) and a forward-and-back biasing structure 10 (FIGS. 1, 2, 4, 11-13) may also be provided to control and regulate movement of the seat 5 about the second pivot axis 6. Exemplar structures for providing an ergonomic motion chair 100 with this range of controlled, dynamic, regulated and adjustable movement are discussed in greater detail below.

General Construction

Figure 1:
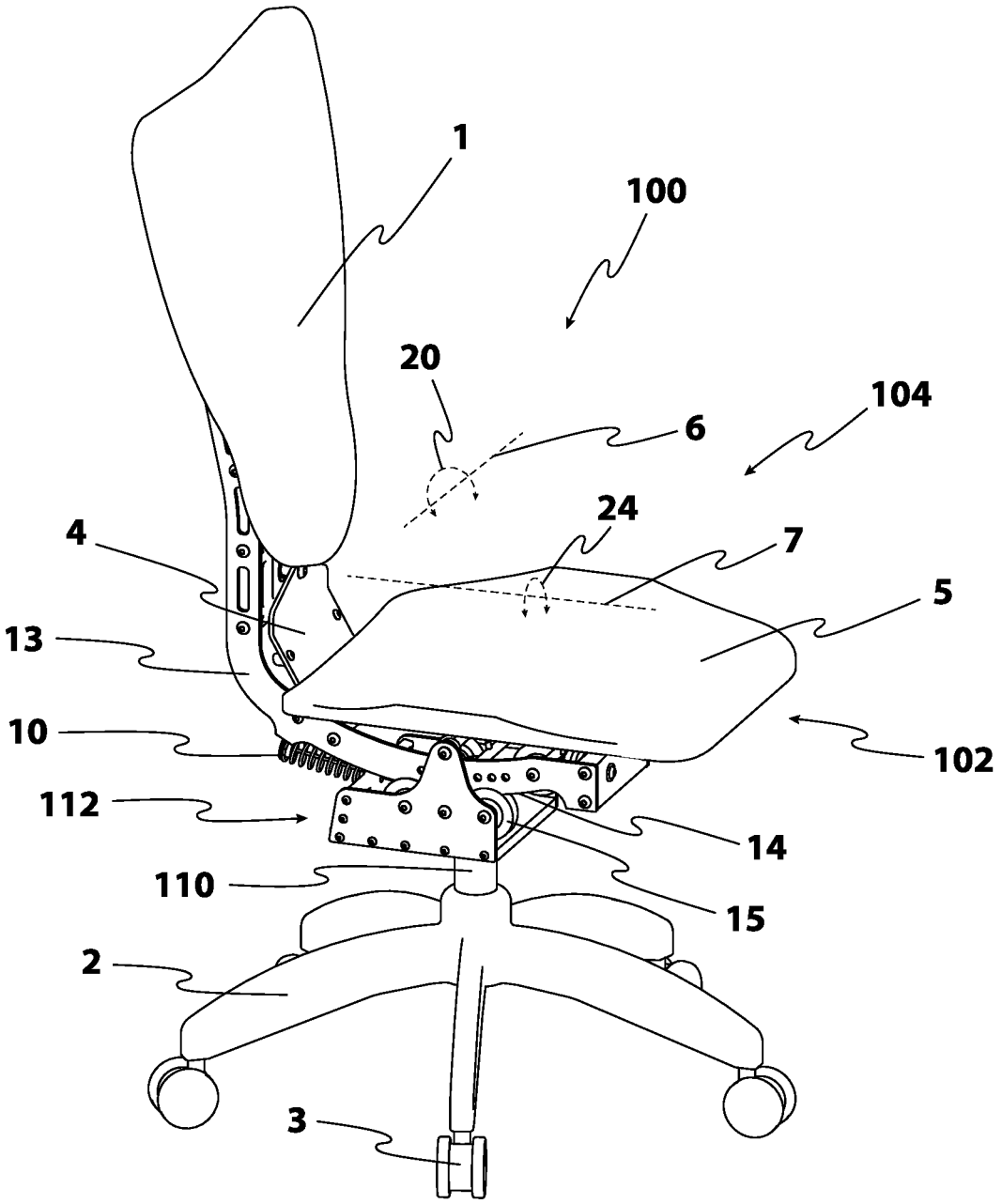
FIG. 1 is a left, front isometric view of an ergonomic motion chair in accordance with an embodiment of the present invention.

Referring to FIG. 1, the ergonomic motion chair 100 may include a base 2 that supports an upwardly extending pole t 10 or the like. Conventional wheels 3 or casters, with or without locking structures, may be attached to the base for engaging the floor upon which the ergonomic motion chair 100 rests. The pole 110 generally defines a longitudinal centerline 44 (FIGS. 2-5) extending upward therefrom. The seat 5 and seat back 1 operably engage an elongated seat spine frame 13, and the spine frame 13 operably engages a base mount 112 secured to the pole of the base.

Side-to-Side Swinging Structure

The seat 5 is moveable relative to the spine frame 13 and seat back 1 and may be padded and/or contoured as desired to comfortably fit a user. The seat 5 may have a left side and a right side that defines a left-to-right center 22 (FIGS. 5, 6, 15 & 20). The seat 5 provides a generally flat seating surface that defines the seat plane 8 as being aligned substantially parallel to the generally flat seating surface and positioned along a lower most surface of the seat 5, when in use and/or when not in use by a user, as best shown in FIGS. 4 & 6 when the ergonomic motion chair 100 is in its forward-and-back neutral position 104 and side-to-side neutral position 102.

Figure 6:
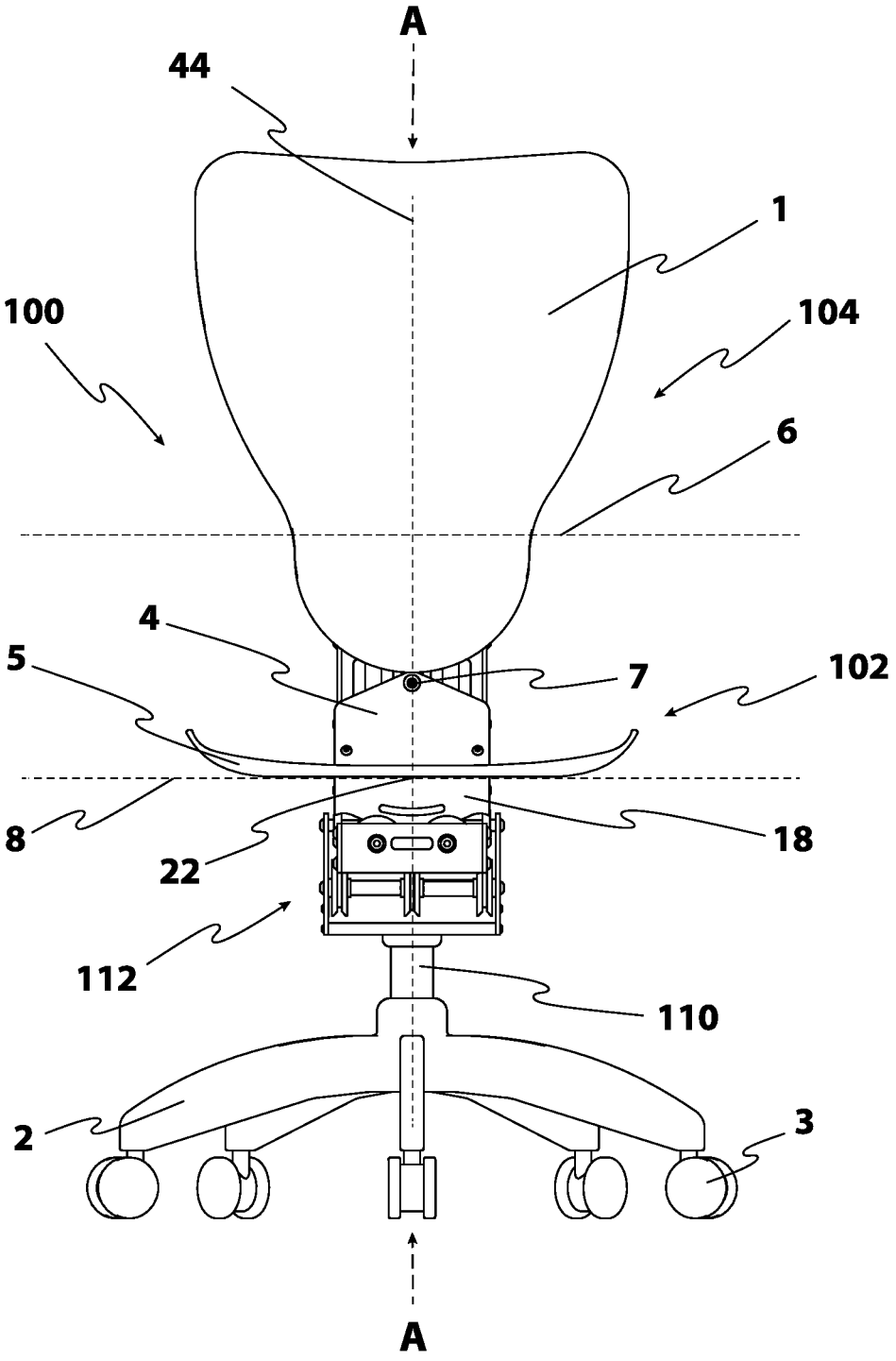
Figure 7:
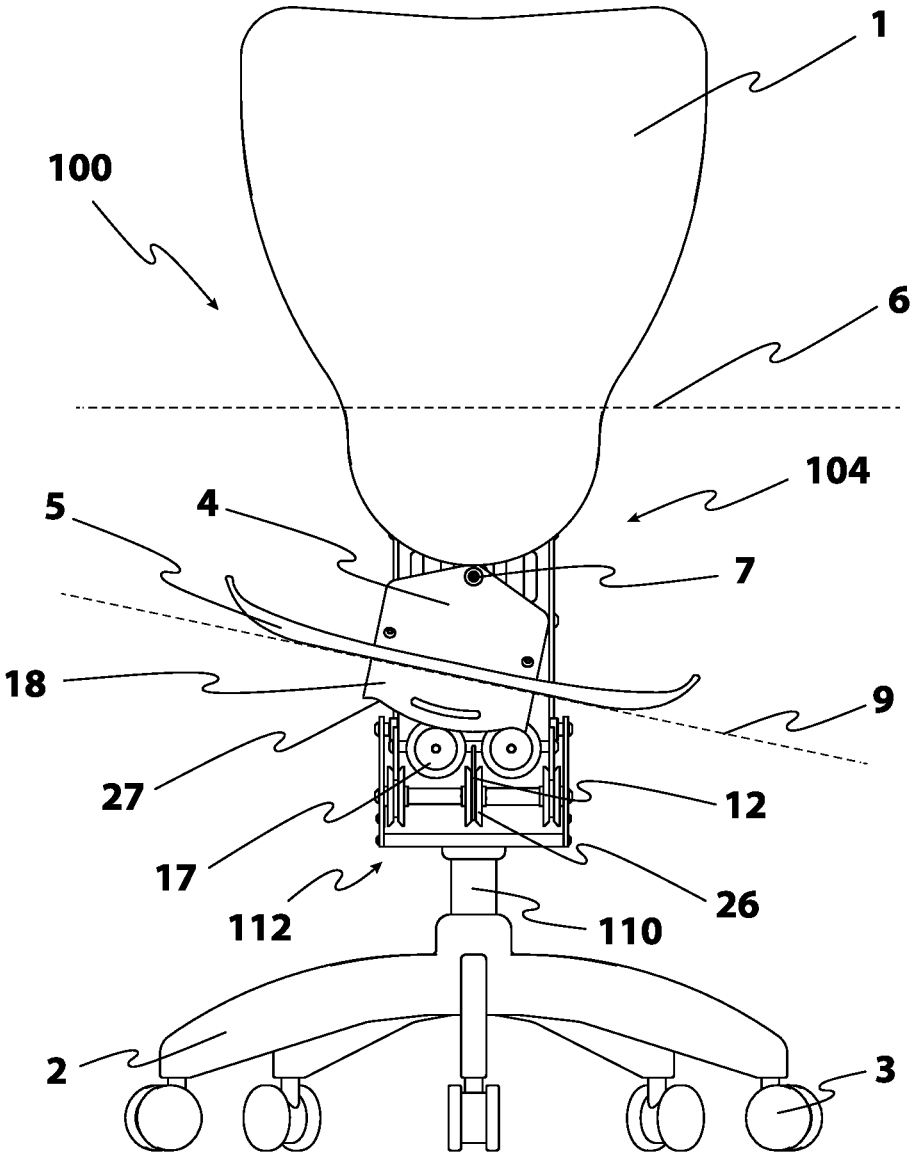
FIG. 7 is a front, plan view, cut away, of the ergonomic motion chair of FIG. 1 with the ergonomic motion chair in the forward-and-back neutral position of FIG. 2 and the right swing position of FIG. 3.
Figure 8:
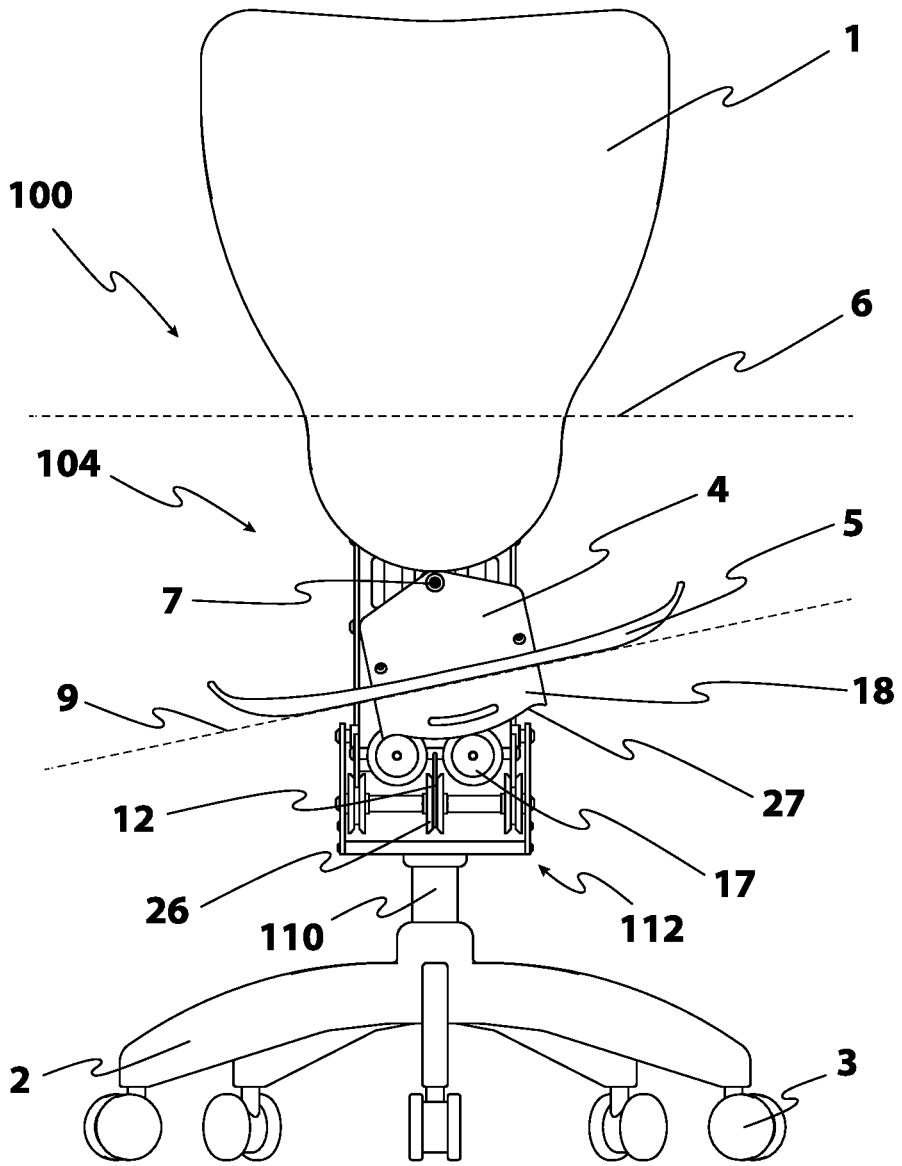
FIG. 8 is a front, plan view of the ergonomic motion chair of FIG. 1 with the ergonomic motion chair in the forward-and-back neutral position of FIG. 2 and the side-to-side neutral position of FIG. 3.

In one embodiment, the seat 5 is operably secured to a seat plate 4 that is pivotably secured to the spine frame 13 as best shown in FIGS. 4 and 6-9. The seat plate 4 is pivotally secured at one end at the spine frame 13 with a pin 120 (FIG. 14, 15) or the like. The opposite end of the plate 4 includes a downwardly extending edge 18 that defines an arcuate rail 14 for operably engaging wheels 17 operably secured to the spine frame to define a swing arc structure 27 as best shown in FIGS. 7 & 8.

Figure 19:
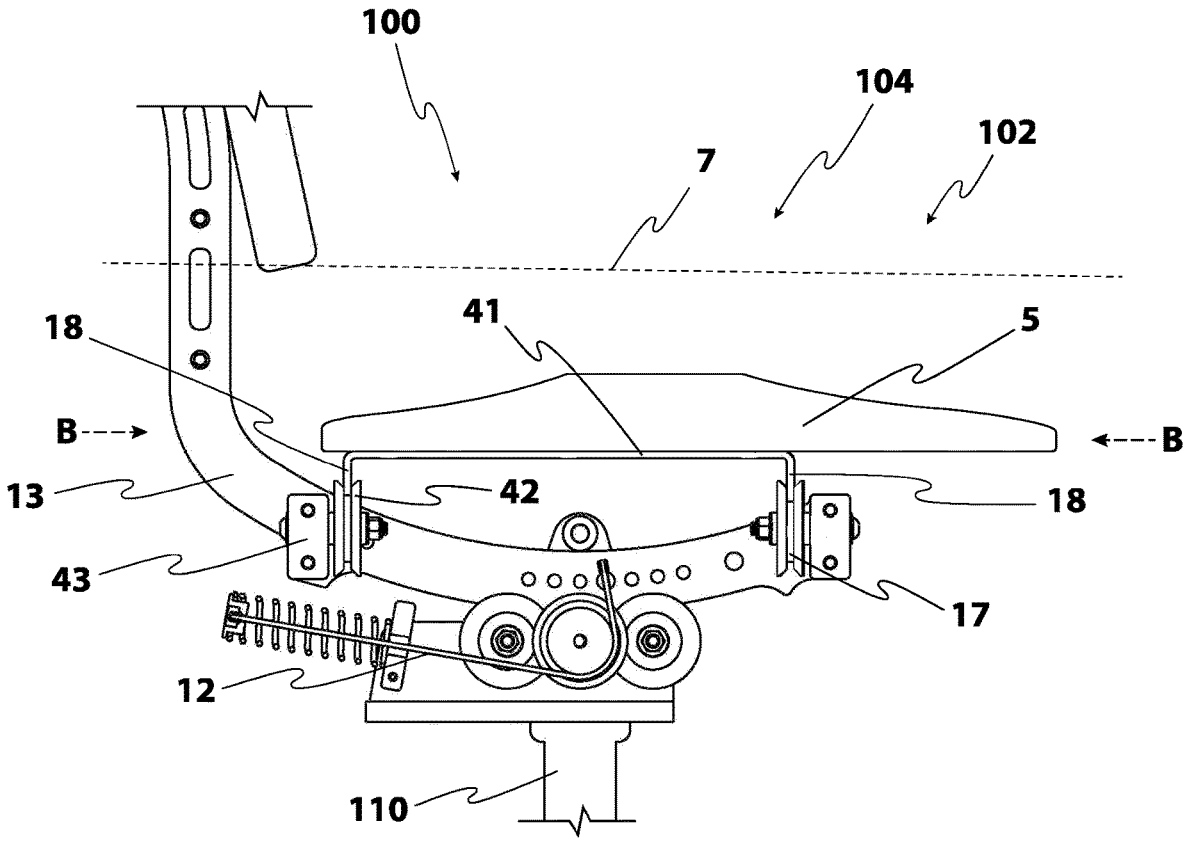
FIG. 19 is an enlarged, fragmentary, left side view cut along arrows B-B, similar to the cut along arrow A-A of FIGS. 6 & 9, of a possible ergonomic motion chair with an alternative structure for providing side-to-side movement about a pivot axis positioned above a seat plane in accordance with an alternative embodiment of the present invention.
Figure 20:
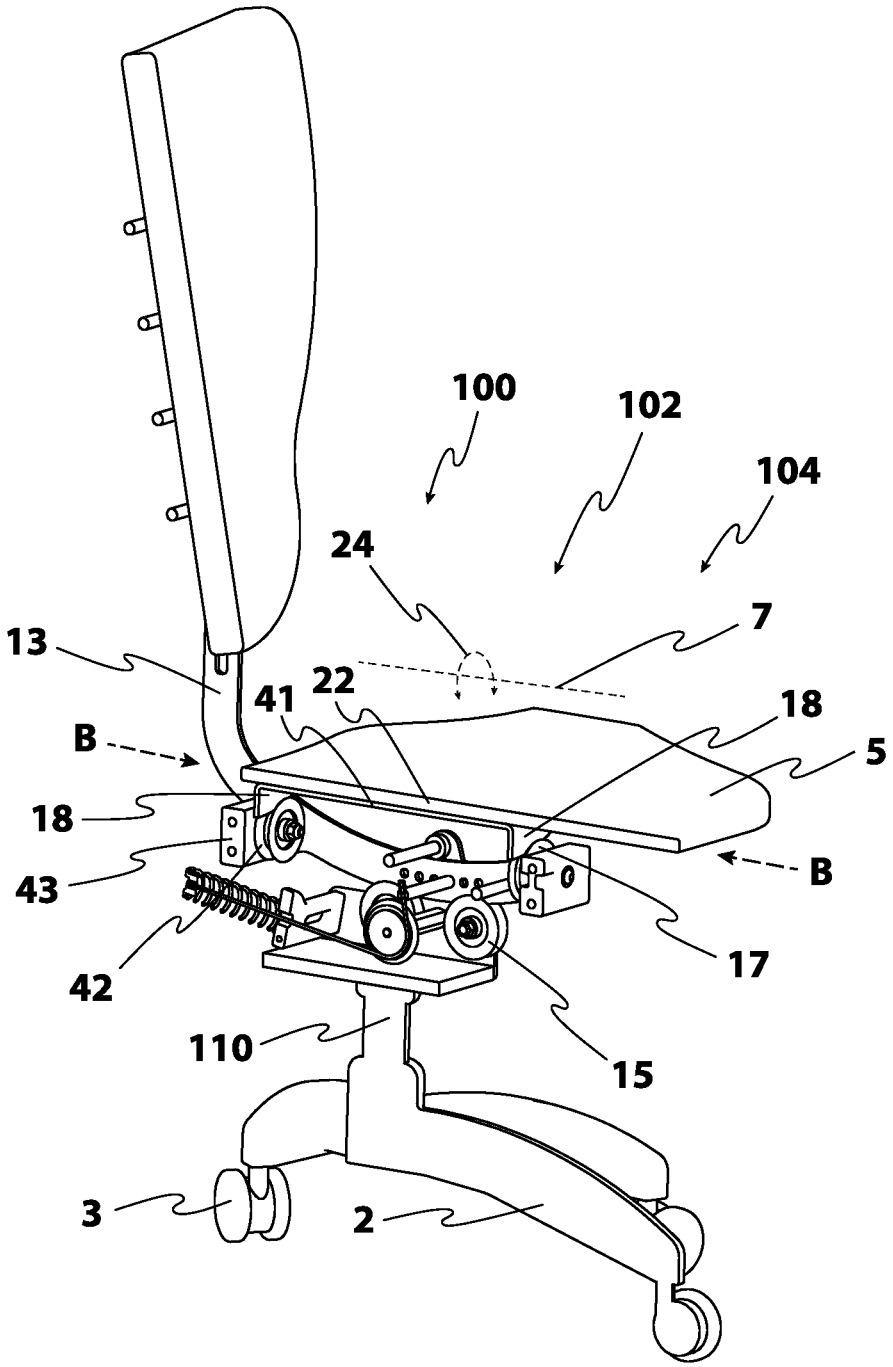
FIG. 20 is a cross-sectional, isometric view of the ergonomic motion chair of FIG. 19.

Alternatively and as best shown in FIGS. 19 and 20, the seat plate 41 can include forward and back arcuate cams 18, or the like, extending downward therefrom, and the swing arc structure 27 can include both forward and aft wheels 17, 42 for operably engaging the forward and back cams, thereby allowing the seat to pivot side-to-side along side-to-side pivot axis 7 without requiring a physical pivot pin at the axis 7. It is appreciated that the seat plate 41 may be operably secured to be aligned and side-to-side swing operable with the fore and aft wheels 17, 42, which may be operably secured to the spine frame 13 via operable securing structures 43. Of course, the location of the wheels and engaging frame elements may be reversed with the wheel's operably secured to the seat plate and the cam embedded in the frame.

Figure 9:
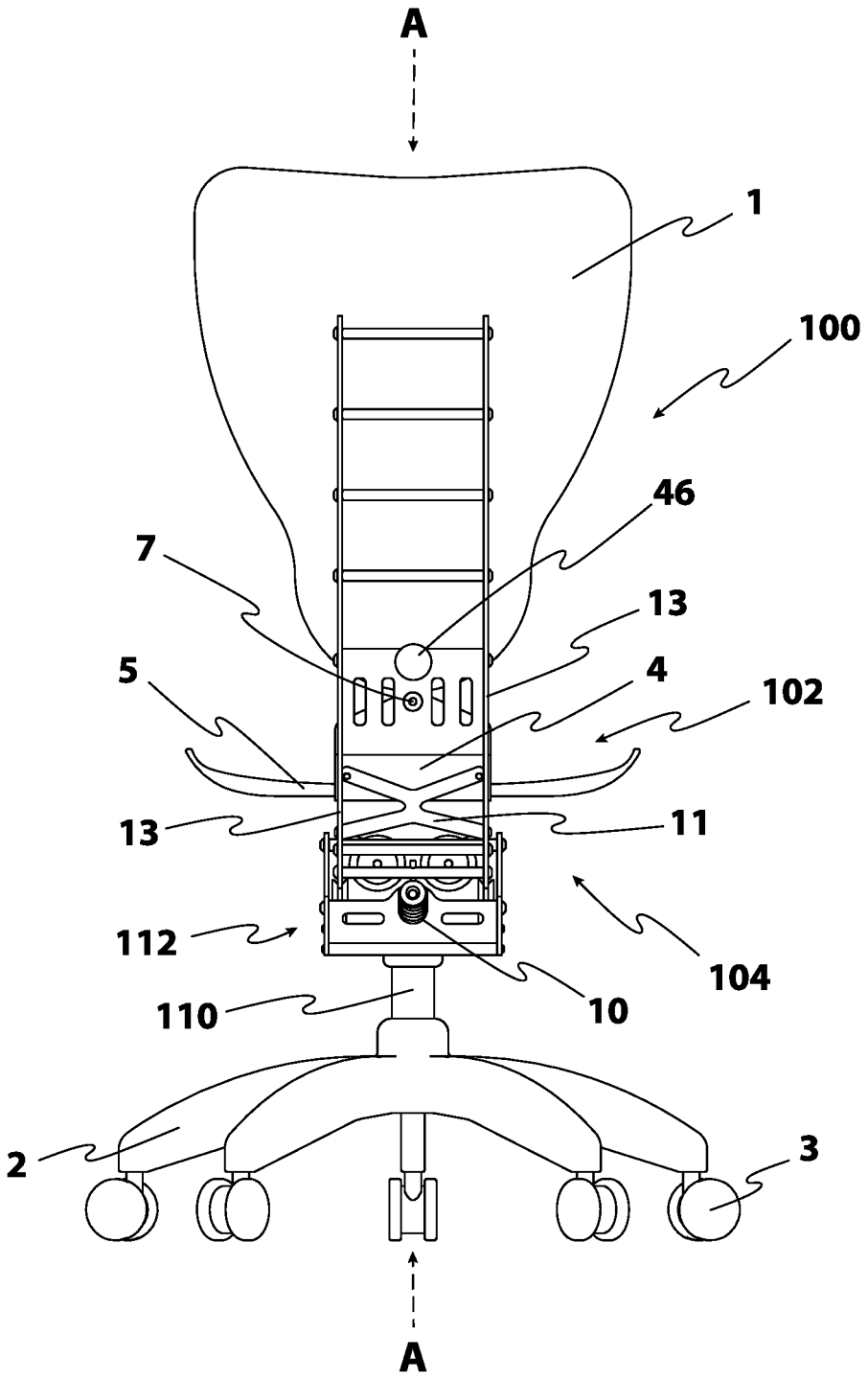
FIG. 9 is a back view of the ergonomic motion chair of FIG. 1 with the ergonomic motion chair in the forward-and-back neutral position of FIG. 2 and the side-to-side neutral position of FIG. 3.

It can be appreciated that this structure allows the seat 5 to pivot or swing about side-to-side pivot axis 7 in the direction of arrow 24 (FIGS. 1, 2, 5 & 20) with fewer structures interfering with a user's ability to sit in the seat. Moreover, because the left-to-right center 22 of seat 5 is positioned below the side-to-side pivot axis 7, gravity will urge the seat 5 to return and rebalance to its side-to-side neutral position 102. Preferably, a resilient biasing structure 11 extends between the spine frame 13 and seat plate 4 as shown in FIGS. 4 & 9, and described above for alternative seat plate 41 (FIG. 19, 20), thereby further urging the seat to its side-to-side neutral position 102 (FIG. 3) and providing a selectable and defined resistance to motion away from the side-to-side neutral position 102 (FIG. 3). Alternative resilient members 11, each having a unique resistance quality, may be provided to allow a user to adjust the biasing force as desired. An adjustable alternative biasing force structure may also be provided.

Figure 5:
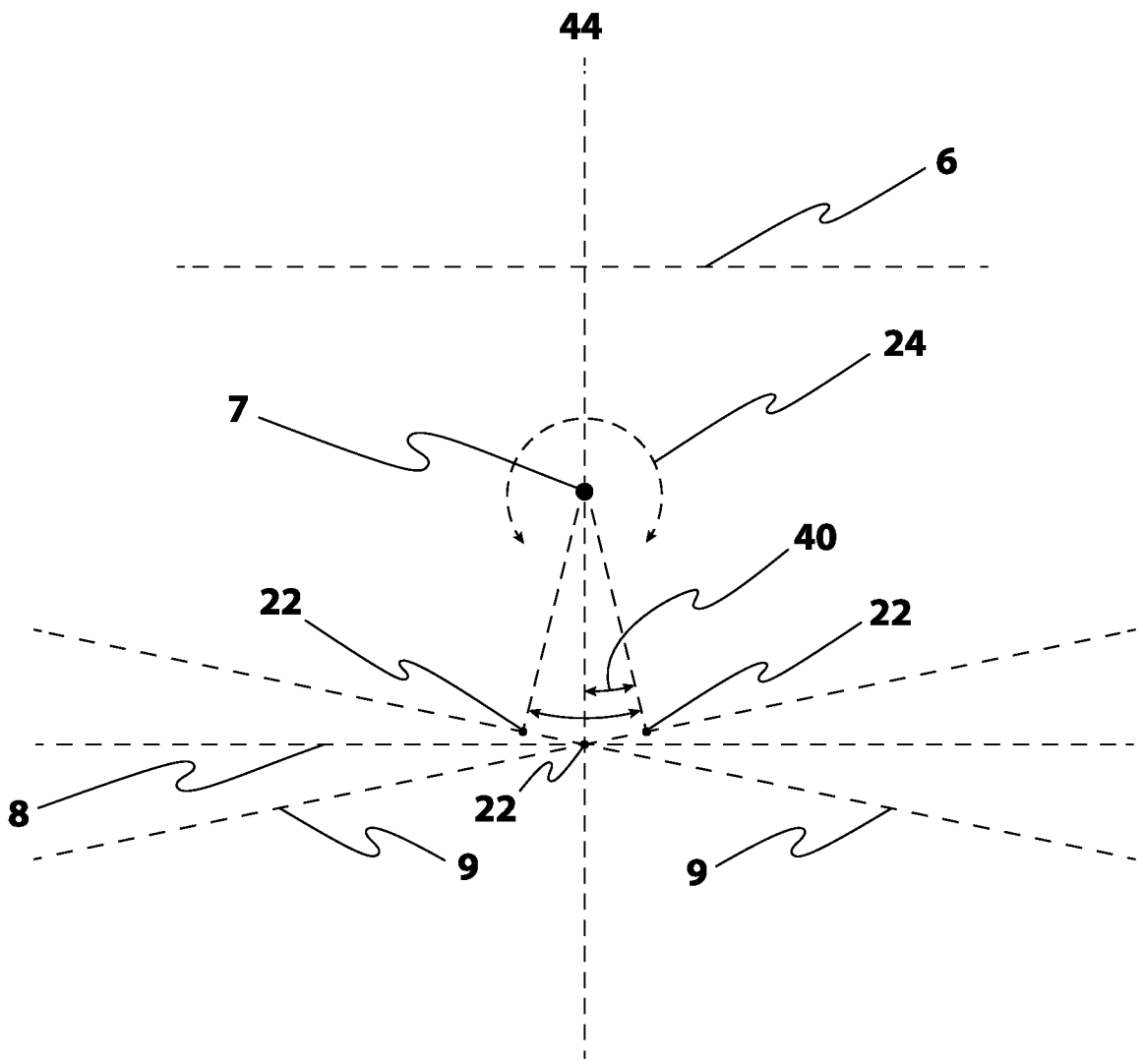
FIG. 5 is a schematic front view of the geometry of the ergonomic motion chair of FIG. 1 showing a possible side-to-side pivot axis positioned above the seat plane of FIG. 3 and FIG. 4.

Referring to FIG. 5, the side-to-side swinging of the seat plane 8 relative to the side-to-side pivot 7 is shown schematically. The side-to-side pivot axis is positioned above the seat plane 8, when in the neutral position and above the left-to-right center 22, and the structure preferably allows the side-to-side pivot angle 40 to be about 10 degrees or between 5 and 15 degrees in either direction to allow the activated side-to-side seat plane 9 and travel of left-to-right center 22 to be achieved as shown.

Forward-and-Back Gliding Motion Structure

Figure 10:
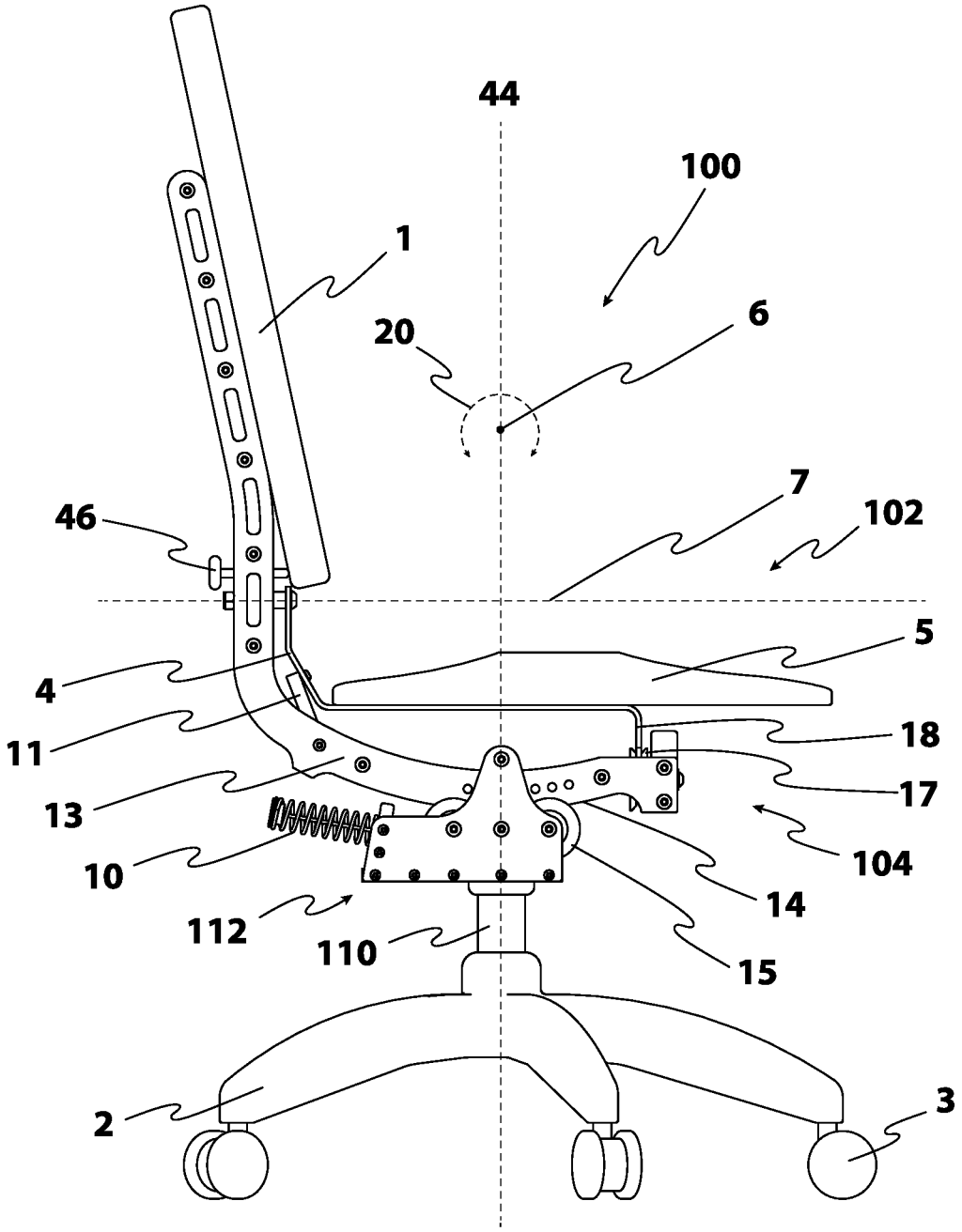
FIG. 10 is a left side plan view of the ergonomic motion chair of FIG. 1 in the forward-and-back neutral position of FIG. 2 and the side-to-side neutral position of FIG. 3.
Figure 13:
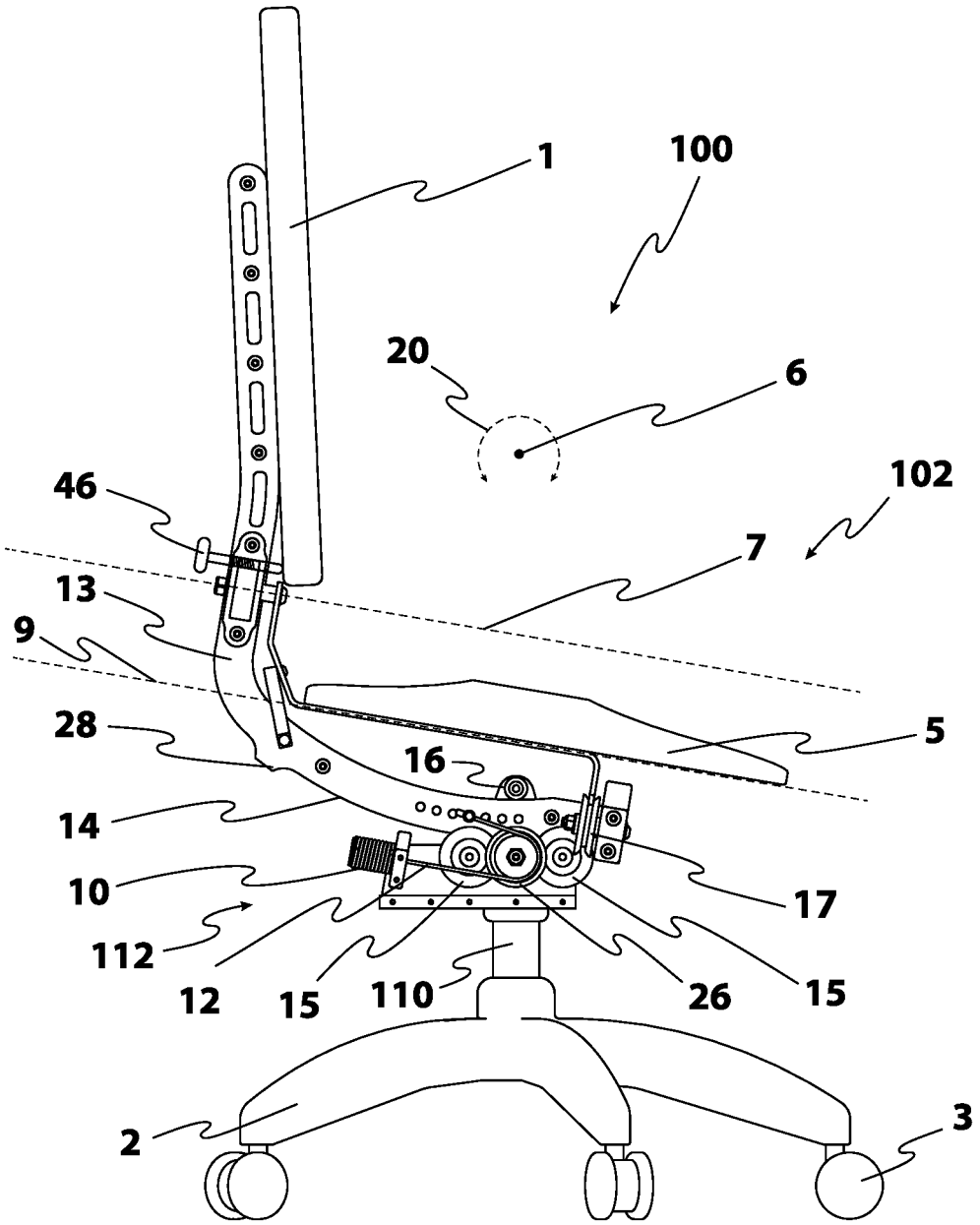
FIG. 13 is the left side plan view of the cut-away view of the ergonomic motion chair of FIG. 11 with the ergonomic motion chair in the forward position of FIG. 2 and the side-to-side neutral position of FIG. 3.
Figure 14:
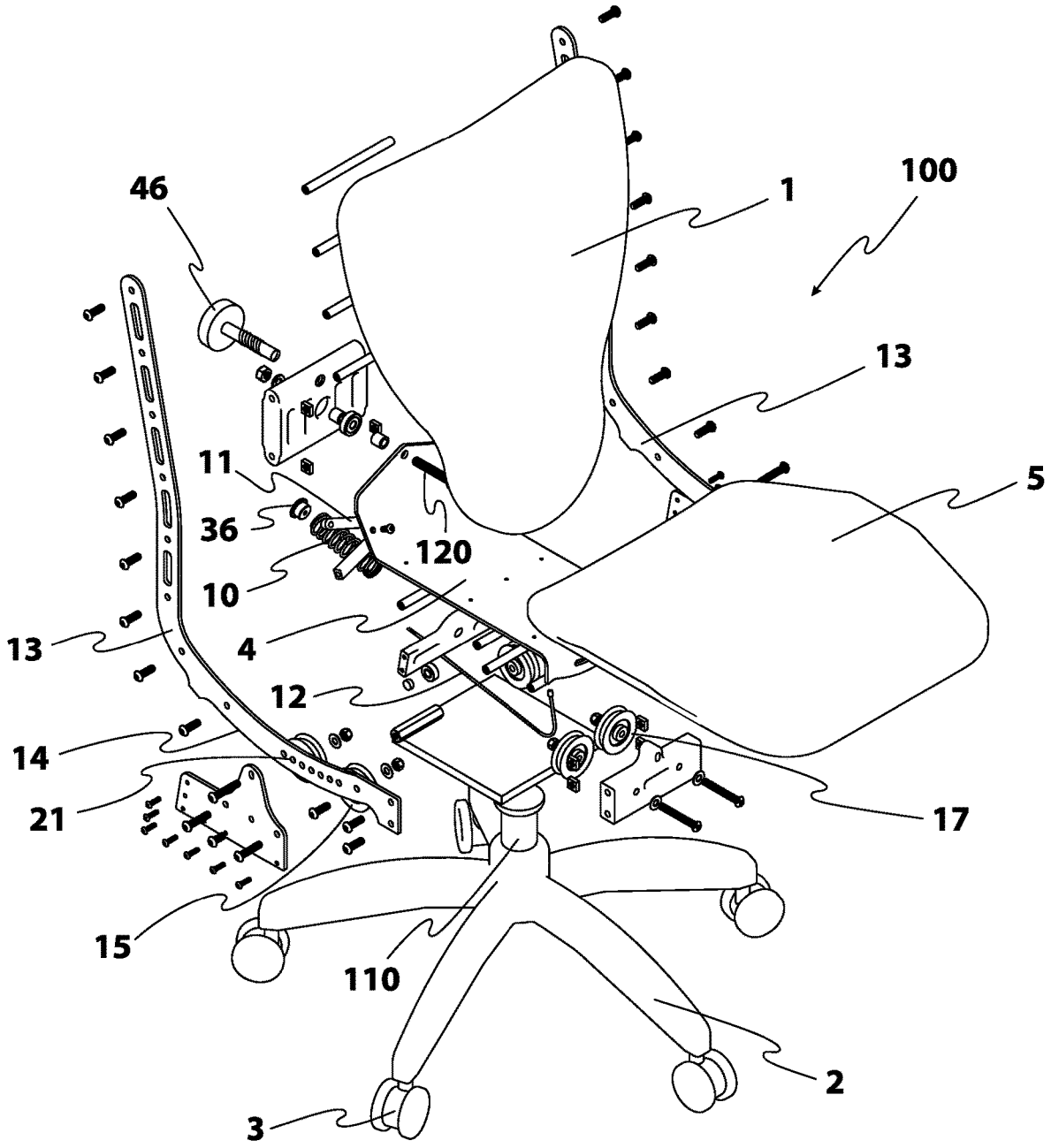
FIG. 14 is a left, front exploded view of the ergonomic motion chair of FIG. 1.
Figure 15:
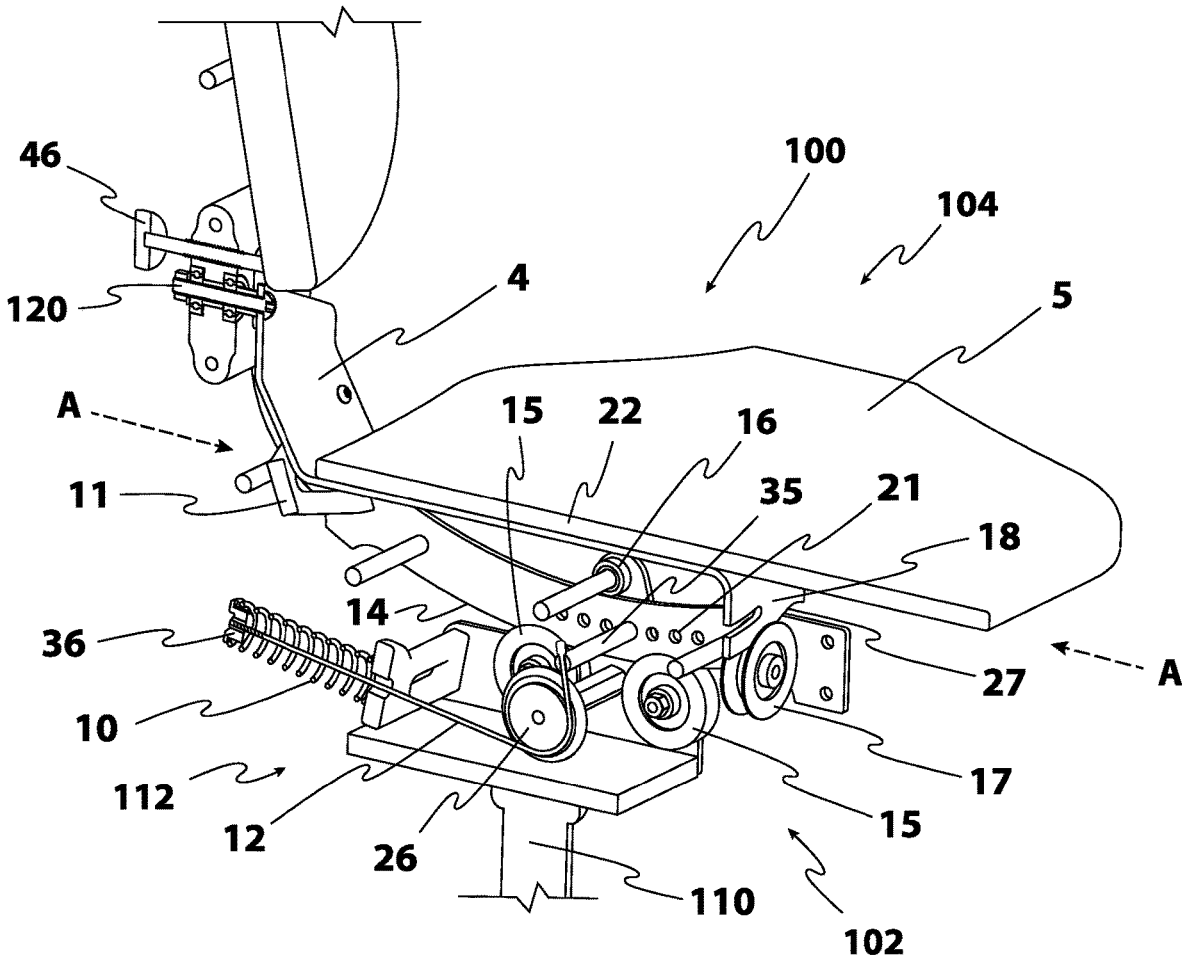
FIG. 15 is an enlarged, cut-away, isometric view of a portion of the ergonomic motion chair of FIG. 1 taken along arrow A-A of FIGS. 6 & 9 with the ergonomic motion chair in the front-and-back neutral position of FIG. 2 and the side-to-side neutral position of FIG. 3.
Figure 16:
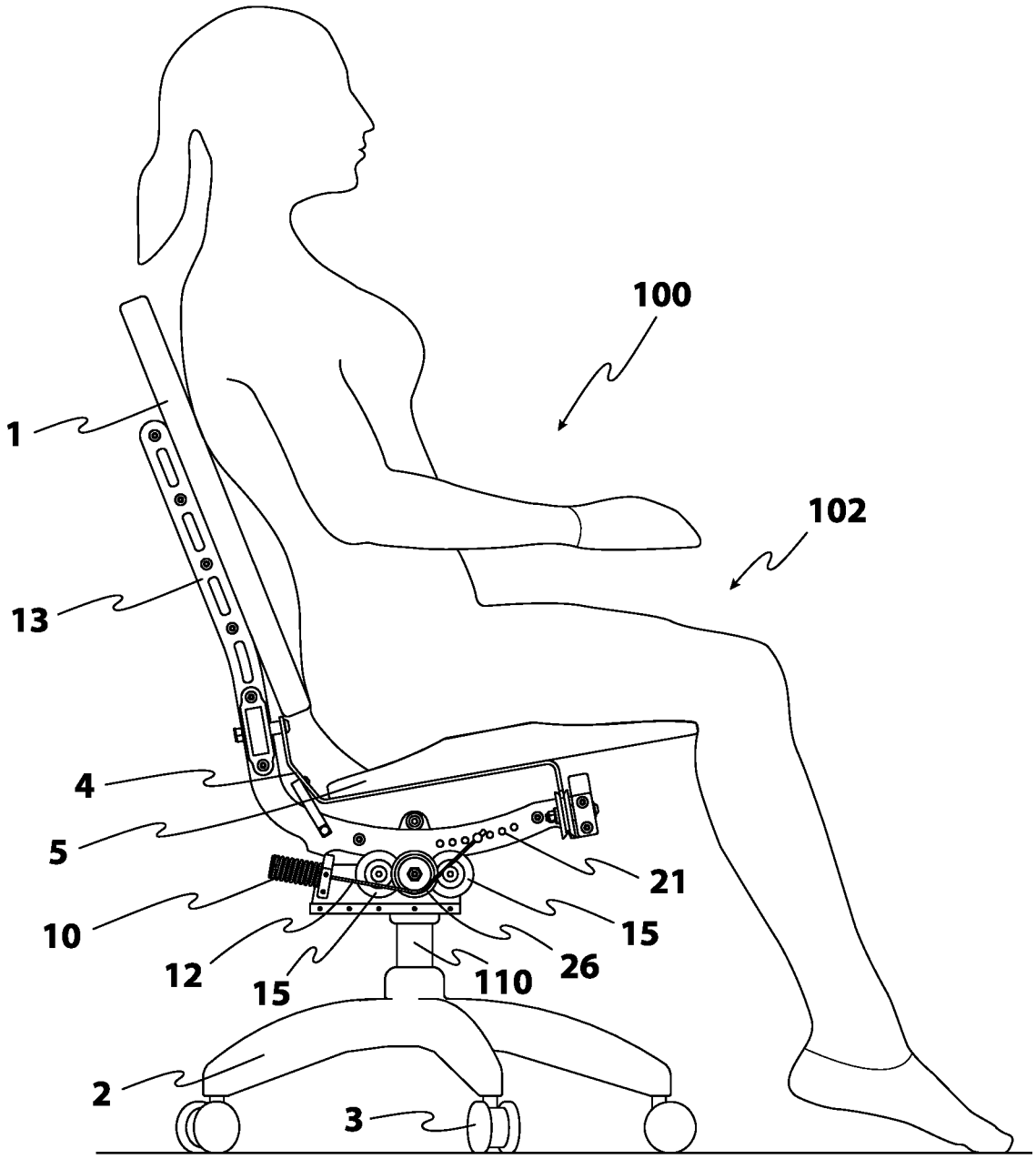
FIG. 16 is the left, side plan view of the cut-away view of the ergonomic motion chair of FIG. 12 with a user shown sitting in the ergonomic motion chair to demonstrate possible fit and orientation.
Figure 17:
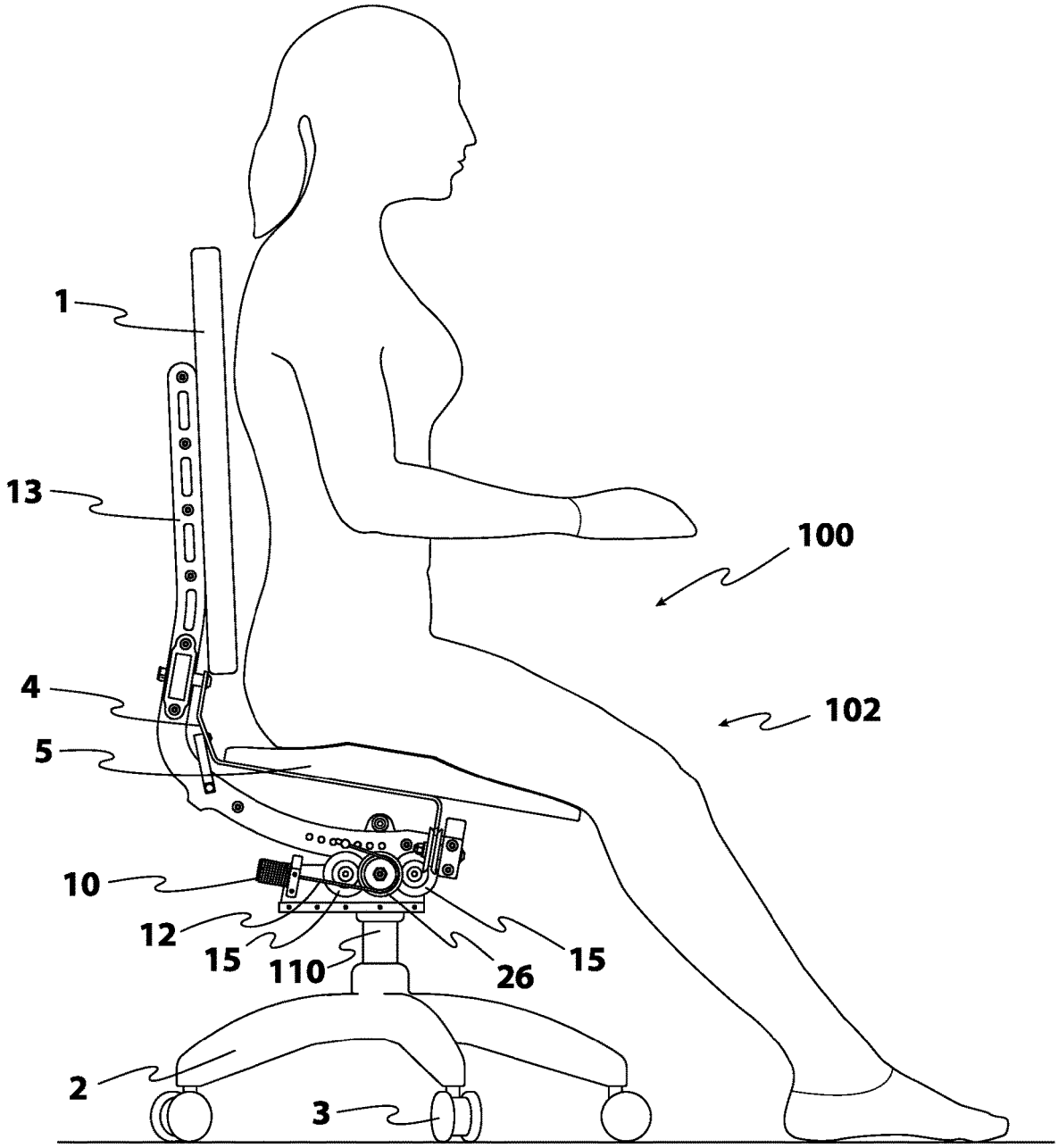
FIG. 17 is the left, side plan view of the cut-away view of the ergonomic motion chair of FIG. 13 with a user shown sitting in the ergonomic motion chair to demonstrate possible fit and orientation.

As best shown in FIGS. 9 & 14, the spine frame 13 may be formed by two parallelly-aligned curved rails joined together. The edges of the rails extend downward to define an arcuate rail 14 that operably engage wheels 15 operably secured to the base mount 112 as best shown in FIGS. 10, 13 & 15. A guide structure, or wheel 16 (FIGS. 11-13 & 15) or other control structure or control assembly may engage a portion of the rail to operably hold the spine frame 13 in place on the base mount 112, while still allowing the spine frame 13 to glide forward-and-back along the forward-and-back pivot axis 6. It is appreciated that the location of the wheels and engaging arcuate rail elements may be reversed with the wheels operably secured to the spine frame and the arcuate rails 14 secured to the base.

As best shown in FIG. 4, it can be appreciated that the section of the part having the contour of the edges of the arcuate rails 14 (FIG. 4) can be shaped to provide movement of the spine frame 13 about a virtual or projected axis of rotation such as the forward-and-back pivot axis 6. It can be appreciated that the contour of the edges of the arcuate rails 14 (FIG. 4) may be shaped to deliver the exact location of the virtual, projected pivot axis 6 above the seat plane 8 depending on the arcuate rail radius or the like. This contour shaping can be also applied to the side-to-side axis 7 delivered by swing arc structure 27 (FIG. 7, 8). Preferably, pivot axis 6 is aligned with the longitudinal centerline 44 of the frame and allows the seat plane 8 to move about the axis 6 in the direction of arrow 20 (FIGS. 1, 2, 4, 10-13 & 20) as shown, and as shown operably with the activated seat plane 9 (FIGS. 2.3.5.7.8.12.13). More preferably, the arcuate rails 14 of the spine frame 13 are shaped so as to allow for, and optimize for, a glide angle 39 of about 18 degrees or between 10-25 degrees backward from the forward-and-back neutral position and about 10 degrees or between 5 to 12 degrees forward from the forward-and-back neutral position. The degrees of freedom along the arcuate rails 14 may be controlled by stopping features or structures such as 28 or the like. For example, a user may alternatively position the arcuate rail at a desired position and engage a structure that holds the arcuate rail at that desired position.

Referring to FIG. 15, the forward-and-back biasing structure 10 may include a cable 12 extending from the base mounting portion 112, around a roller or cable pulley 26 (FIG. 7, 8 11-13), to the spine frame 13. Spaced apart holes 21, or other fixing structures, along the rails of the spine frame allow a user to pre-select a desired forward-and-back neutral position of the ergonomic motion chair 100 simply by adjusting the attachment point of the cable 12 to a different hole, or desired location, along the spine frame 35 A resilient member such as a spring 10 or the like urges tension of the cable 12, thereby urging the selected hole, or location of the spine frame mount 35, to its lowest most point thereby defining a neutral position.

It can be appreciated that this configuration increases the tension when the seat is moved throughout the range of motion both forward or backward from the neutral position as shown in FIGS. 2, 11-13, 16 & 17. Moreover, an adjustment structure 36 (FIG. 15), or the like, such as a screw and nut operably secured between the spring 10 and cable 12 allows the tension on the cable to be adjusted as desired or pre-set as desired to the user's weight and preference.

Figure 11:
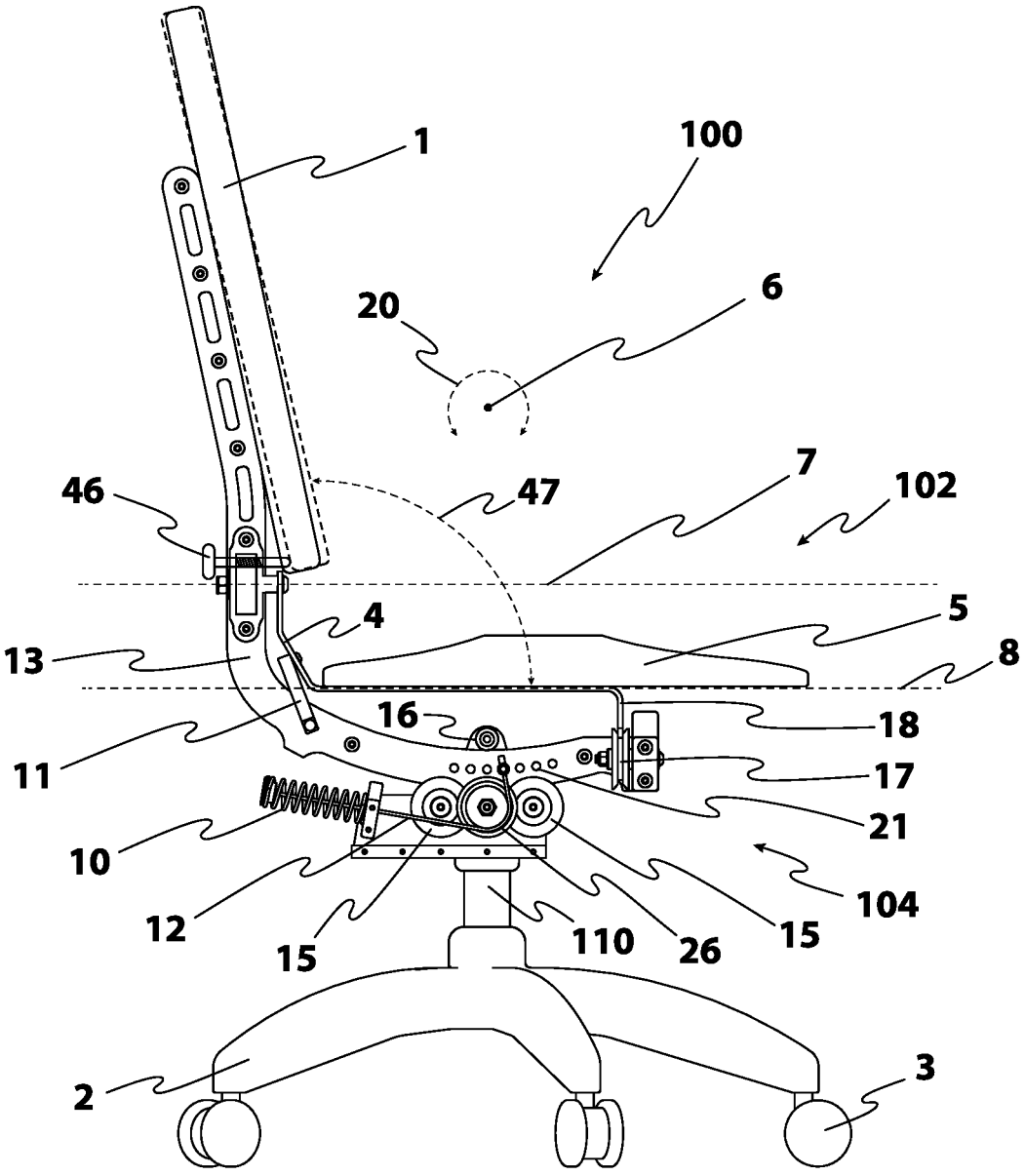
FIG. 11 is the left side plan view of the ergonomic motion chair of FIG. 10, cut away along arrows A-A in FIGS. 6 & 9 to show internal detail.
Figure 12:
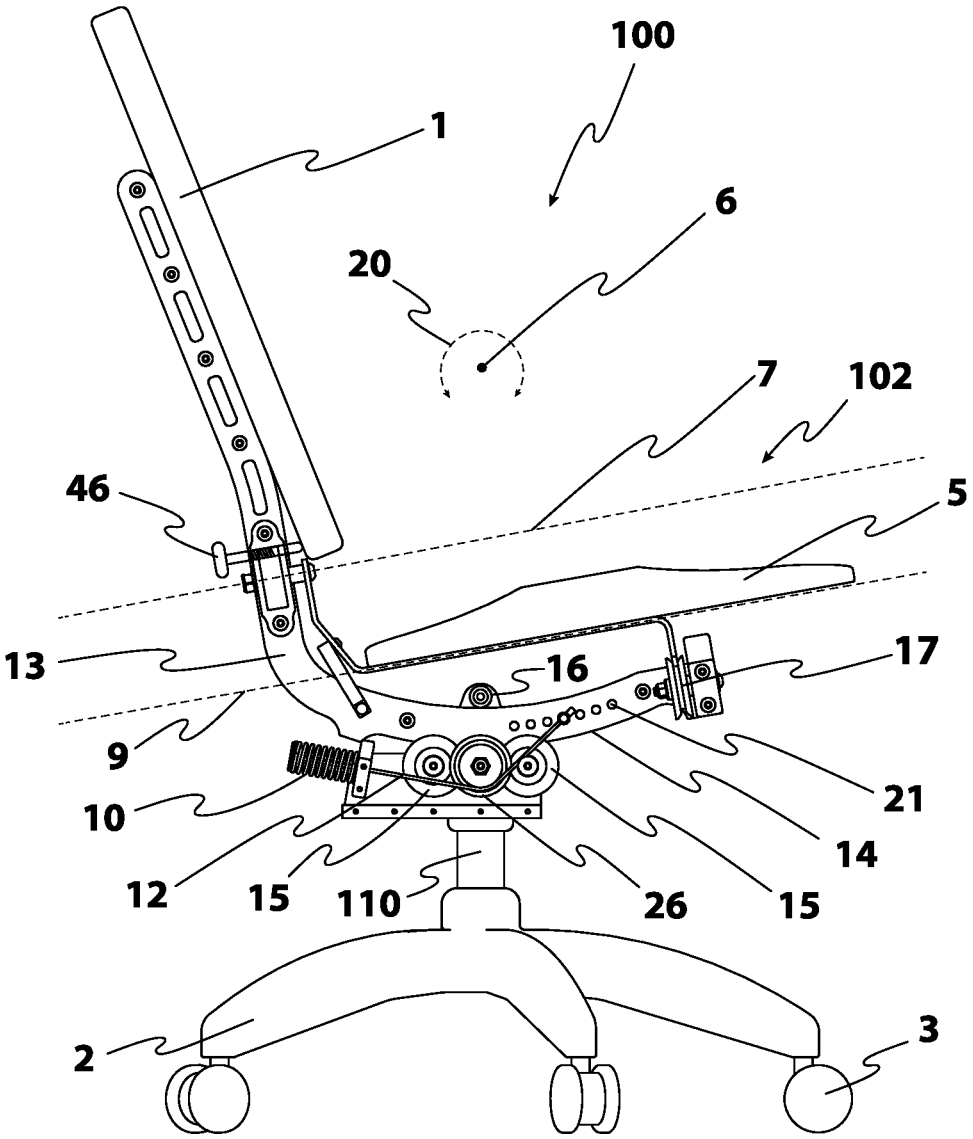
FIG. 12 is the left side plan view of the cut-away view of the ergonomic motion chair of FIG. 11 with the ergonomic motion chair in the back position of FIG. 2 and the side-to-side neutral position of FIG. 3.

If desired, the seat back 1 may be pivotably secured to the spine frame as shown in FIG. 11. An adjustment structure 46, or the like, such as a screw or of the like extending from the spine frame to the seat back can be used to move and hold the seat at a pre-selected, desired position 47 (FIGS. 4 & 11) about its pivot axes thereby further improving comfort and fit of the ergonomic motion chair 100. This preselected position of the seat back may remain in place throughout the entire range of dynamic motion of the ergonomic motion chair 100.

Fit, Use & Operation

Having fully described mechanical aspects of a preferred embodiment of the invention, the improved fit and function of the ergonomic motion chair 100 become apparent. For example, a user resting on the seat may swing side-to-side about a pivot axes located above the seat plane while still offered the ability to move around on the seat, rather than being constrained within a bucket that only pivots forward-and-back.

Moreover, consistent and predictable back support may be provided by an adjustable-position seat back that, once adjusted into a proper fit and position, may move forward-and-back with the seat to maintain the same position relative to the seat throughout this forward-and-back range of motion of the seat. This consistent position of the seat relative to the seat back throughout the forward-and-back range of motion of the ergonomic motion chair, allows the user to maintain optimal fit, comfort and back support throughout the entire range of motion of the ergonomic motion chair 100.

In addition, suspending the seat below a front-to-back pivot axis and a side-to-side pivot axes allows the position of the seat to be infinitely adjustable in any desired position while not forcing a user to balance on the seat to hold a desired neutral position. Rather, gravity, the user's weight and the biasing structures urge the seat into its neutral position. In contrast, seats and buckets resting on balls, universal joints, or other structures that position the pivot axes below the seat require constant action on the part of the user to balance the seat into a desired position.

Figure 18:
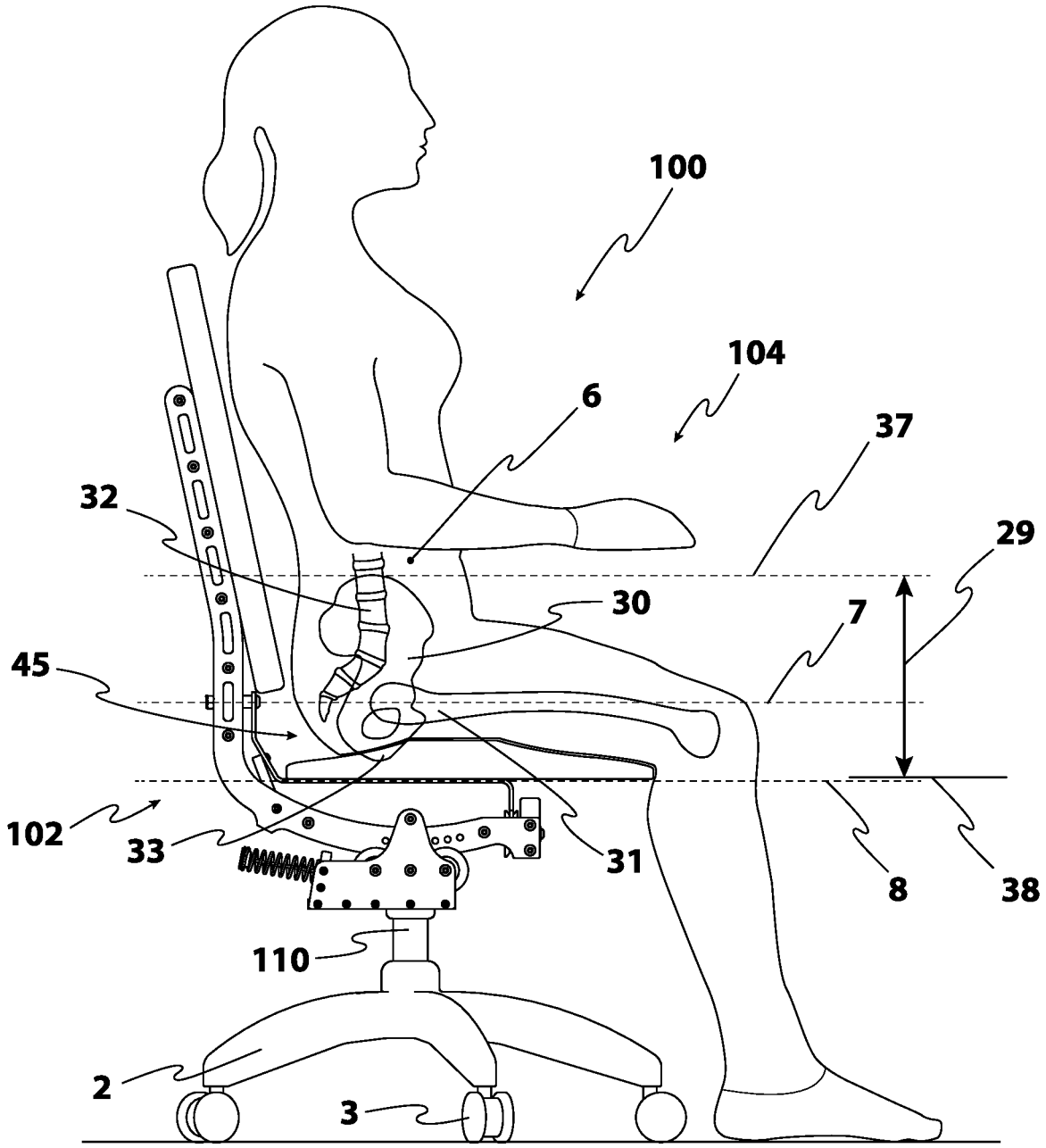
FIG. 18 is the left, side plan view of the ergonomic motion chair of FIG. 10 with a cut away of the user shown sitting in the chair to demonstrate possible fit, orientation, and possible pivot locations relative to a human body anatomy.

Referring to FIG. 18, the optimal location of the first axis of rotation may be in the approximate area where the spine of a human user 32 intersect with the pelvic bone 30 and the possible locations of the first axes of rotation 7 relative to a user are shown. In a preferred embodiment, the optimal range of possible locations 29 of the first axes of rotation 7 may be between the approximate top at of the pelvic bone 30 contained in a human body 37 and the lower most portion 38 of the human body's torso and buttocks 45 (FIGS. 2, 3 & 18) when seated but ideally slightly above the seat plane 8. The axes of rotation may be at or below the Femur bone 31 and the lowest most part of the Ischial Turbosities bone 33 when seated and still above the seat plane 8 to take into consideration the muscle and fat of a user's anatomy and still achieve the benefits of the invention. The user's body may extend below the seat plane 8 as shown, thereby pushing the relative seat plane 8 downward when the chair is in use with some alternative hammock style, or mesh, seat surface covering designs.

The advanced improvements with this design can be more fully understood in FIG. 3 whereby the user is able to move seat plane 8 into the left and right swing positions 9 and release their hip angle 34, and lower torso 45, while maintaining the upper body and upper spine 32 generally in the upright position about the longitudinal centerline 44. This is appreciated because the first axes of rotation 7 is above the seat plane 8 and generally aligned and more closely adjacent to the human spine in the areas of desired mobility and flexibility, along with the side-to-side swing movement can be achieved quickly with low effort and movement of the upper body thereby providing stability in the upper body whereby the arms can maintain freedom with reduced or no restrictions to perform other efforts such as typing simultaneously while moving.

It can be fully appreciated and understood that with the combined pivots and synchronous swinging motions of the first and second axes of movement in tandem together, an infinite number of angles about two axes simultaneously can be achieved that are more fully linked to the natural, intuitive human body movements, in a wide degree of angles, with minimal effort of the user.

I claim:

1. A chair comprising:

a frame;

a seat defining a seat plane and operably secured to the frame, the seat having a front side, a back side, a left side, a right side, and a left-to-right center;

the seat substantially pivotable left side to right side about a first axis of rotation;

the first axis of rotation positioned above the seat plane such that the left-to-right center of the seat travels and moves about and below the first axis of rotation.

2. The chair of claim 1, further including:

the seat substantially pivotable front side to back side about a second axis of rotation; and, the second axis of rotation positioned above the seat plane.

3. The chair of claim 2, further including a back adjusting structure operably secured between a back of the seat and a spine frame for adjusting the position of the back on the spine frame while maintaining a consistent angle between a back panel and the seat plane throughout the range of motion about the second axis of rotation.

4. The chair of claim 2, wherein the second axis of rotation has a front-to-back glide angle selected from the group consisting of between 10-25 degrees backward from the forward-and-back neutral position to between 5 to 12 degrees forward from the forward-and-back neutral position and approximately 18 degrees backward from the forward-and-back neutral position to approximately 10 degrees forward from the forward-and-back neutral position.

5. The chair of claim 2, wherein the seat is simultaneously pivotable about the first axis of rotation and the second axis of rotation.

6. The chair of claim 2, wherein the first axis of rotation is positioned below the second axis of rotation.

7. The chair of claim 1, further including the seat having a neutral position relative to the frame and further including a biasing structure for biasing the seat to the neutral position.

8. The chair of claim 1, wherein the frame includes an elongate spine frame and a base and the seat is operably secured to an elongate spine frame that operably engages the base.

9. The chair of claim 8, wherein:

one of the elongate spine frame and the base has a curved portion; and, the other of the elongate spine and base has at least one roller that operably engages the curved portion to allow the seat to be substantially pivotable to travel and move about the second axis of rotation.

10. The chair of claim 8, wherein:

the back of the seat includes a back-mounting portion for operably securing to the spine frame;

the front of the seat includes a front-mounting portion for operably engaging the spine frame; and, the frame includes at least one roller for operably engaging at least one of the front-mounting portion and back-mounting portion thereby allowing the seat to be substantially pivotable to travel and move side-to-side about the first axis of rotation.

11. The chair of claim 1, further including a side-to-side biasing structure operably secured between the seat and frame to bias the seat to a neutral position.

12. The chair of claim 11, wherein the biasing structure is a resilient member.

13. The chair of claim 1, further including a forward-and-back biasing structure operably secured between the seat and frame to bias the seat to a forward-and-back neutral position.

14. The chair of claim 13, wherein the biasing structure is a resilient member.

15. The chair of claim 13, wherein the biasing structure includes:

at least one cable operably extending from the base to the seat;

and, a resilient member placing tension on the cable thereby urging the seat to return to a its forward-and-back neutral position.

16. The chair of claim 15 further including an adjustment structure for adjusting the compression on the resilient member thereby allowing the tension on the cable to be adjusted.

17. The chair of claim 1, wherein the first axis of rotation has a side-to-side pivot angle selected from the group consisting of between 5 to 15 degrees and approximately 10 degree from a side-to-side neutral position.

18. The chair of claim 1, wherein the first axis of rotation is positioned between 0.25 inches and 12 inches above the seat plane when the chair is not in use.

19. The chair of claim 1, wherein the first axis of rotation is positioned between the approximate top of the pelvic bone contained in a human body and the lower most portion of the human body torso and buttocks when seated in the chair in the neutral position.

20. A chair comprising:

a frame;

a seat operably secured to the frame defining a seating surface, the seat having a front side, a back side, a left side, a right side, left-to-right center, and a neutral position relative to the frame, and;

the seat substantially pivotable left side to right side about a first axis of rotation; and, the first axis of rotation positioned above the seating surface when the chair is in use such that the left-to-right center of the seat swings and moves about and below the first axis of rotation.

21. The chair of claim 20, wherein the first axis of rotation is positioned between an approximate top of a pelvic bone contained in a human body having a torso and buttocks, and the lower most portion of the human body torso and buttocks when the body is seated in the chair in the neutral position.

* * * * *